US005467513A

United States Patent [19]

Steiner et al.

[11] Patent Number: 5,467,513

[45] Date of Patent: Nov. 21, 1995

[54] METHOD AND APPARATUS FOR HEAT-SETTING CARPET YARN USING VARIABLE YARN LAYING MECHANISM

[75] Inventors: Erwin Steiner, Clover; Rolf Mischker, Fort Mill, both of S.C.

[73] Assignee: American Suessen Corporation, Charlotte, N.C.

[21] Appl. No.: 271,911

[22] Filed: Jul. 8, 1994

[51] Int. Cl.[6] ..... D02G 3/00

[52] U.S. Cl. ..... 28/281; 28/103; 28/101; 242/157 R

[58] Field of Search ..... 28/101, 102, 103, 28/281, 285; 242/157 R, 158.1; 226/97, 196, 118

[56] References Cited

U.S. PATENT DOCUMENTS

| | | | |
|---|---|---|---|
| 3,126,556 | 6/1959 | Fleissner | 8/151.2 |
| 3,298,079 | 5/1965 | Agett et al. | 28/72 |
| 3,659,439 | 5/1972 | Tindall | 68/5 D |
| 3,781,950 | 1/1974 | Katsuyama et al. | 28/103 |
| 3,902,644 | 9/1975 | Bous | 226/44 |
| 3,945,545 | 3/1976 | Bacro | 226/97 |
| 3,979,930 | 9/1976 | Schyns | 28/281 X |
| 4,095,312 | 6/1978 | Haley | 28/103 X |
| 4,169,707 | 10/1979 | Gloeckler | 8/149.3 |
| 4,174,799 | 11/1979 | d'Agnolo | 28/281 X |
| 4,204,301 | 5/1980 | Corron et al. | 28/281 X |
| 4,207,730 | 6/1980 | Lorenz | 57/351 |
| 4,217,387 | 8/1980 | Viezee et al. | 28/103 X |
| 4,221,031 | 9/1980 | Gilbos | 28/281 |
| 4,316,370 | 2/1982 | Steiner | 68/5 D |
| 4,418,856 | 12/1983 | George | 28/281 X |
| 4,432,503 | 2/1984 | Wedler | 28/101 X |
| 4,507,832 | 4/1985 | Steiner et al. | 28/248 |
| 4,513,514 | 4/1985 | Steiner | 34/24 |
| 4,955,117 | 9/1990 | Crenshaw | 28/281 |
| 4,976,012 | 12/1990 | McConnell | 28/101 X |
| 5,092,139 | 3/1992 | Runser | 68/5 D |

OTHER PUBLICATIONS

Suessen GVA for Carpet Yarn Heat–Setting (technical sales bulletin 017.1735E); American Suessen Corp. of Charlotte, North Carolina.

Suessen/Hörauf technical sales brochure entitled "GVA for Texturing and Heat–Setting Carpet Yarns".

*Primary Examiner*—John J. Calvert

*Attorney, Agent, or Firm*—Evenson McKeown Edwards & Lenahan

[57] ABSTRACT

A method and apparatus is disclosed for heat-setting carpet yarn by conveying continuously running yarn through a heat-setting chamber. To facilitate production of variable texture yarn, a controllable oscillating yarn supply tube assembly is provided for laying down various yarn patterns on a conveyor belt which travels through the heat-setting chamber. The oscillating yarn supply tube assembly is configured to facilitate switch of production between straight-set and various highly crimped textured yarn patterns via simple adjustment of the drive motor which oscillates the yarn supply tube. The apparatus can be used for a new machine as well as for conversion kits for existing carpet heat-setting machines having stuffer boxes supplying highly crimped yarn to a conveyor belt.

57 Claims, 5 Drawing Sheets

METHOD AND APPARATUS FOR HEAT-SETTING CARPET YARN USING VARIABLE YARN LAYING MECHANISM

BACKGROUND AND SUMMARY OF THE INVENTION

The present invention relates to apparatus and methods for heat setting of yarn, especially carpet yarn.

The present invention also relates to apparatus and methods for converting existing yarn heat-setting machines to be adjustably operable for processing a wide range of yarn crimp characteristics from essentially straight-set yarn to highly crimped yarn.

A presently available commercial machine for achieving a relatively straight-set yarn, with low crimp, is the Suessen GVA for Carpet Yarn Heat-Setting, described in the technical sales bulletin 017.1735E, published by the American Suessen Corporation of Charlotte, N.C. (the Suessen Straight-Set Yarn Machine). See also U.S. Pat. Nos. 4,316,370; 4,507,832; and 4,513,514 for descriptions of machines for heat-setting carpet yarn that yield a relatively straight-set yarn.

The Suessen Straight-Set Yarn Machine accommodates continuous heat treatment processing of yarn by conveying the yarn through a heat treatment chamber which is at atmospheric pressure and is open to the atmosphere at both its inlet and outlet ends. In this system, the yarns are wrapped around travelling endless transport ropes in a relaxed skein form with basically no crimp or twist in the yarn so that when it is heat treated it ends up with a straight-set yarn configuration. Since straight-set carpet yarn has enjoyed a substantial portion of the market for carpet yarn for the last several years, this Suessen Straight-Set Yarn Machine has been commercially successful as it produces such straight-set yarn in an economical and reliable repetitive manner.

However, there is also a substantial commercial demand for so called textured or high crimp carpet yarn and various systems have been developed for processing this type of yarn. One such system is the Suessen/Hörauf GVA for Texturing and Heat-Setting Carpet Yarns, described in the published Suessen/Hörauf technical sales brochure entitled "GVA for Texturing and Heat-Setting Carpet Yarns" (hereinafter "The Suessen Textured Yarn Machine"). See also U.S. Pat. Nos. 3,298,079 and 4,169,707 for disclosures of systems for producing textured or high crimp carpet yarns.

The Suessen Textured Yarn Machine processes the yarn through a so-called "stuffer box", disposed upstream of an open weave conveyor belt which carries the yarn through a heat-setting chamber. At the outlet end of the stuffer box, the yarn is piddled in a spaghetti-like pattern onto the flat conveyor belt. The conveyor belt carries the yarn through the heat-setting chamber in the spaghetti-like pattern so that it is heat set with relatively high crimp. This Suessen Textured Yarn Machine has proven to be an economical and reliable system for producing textured carpet yarn.

Although the Suessen Straight-Set Yarn Machine and the Suessen Textured Yarn Machine are quite economical and reliable for producing the respective straight-set yarn and textured yarn, neither of these machines is adaptable for producing both straight-set and textured yarn. Since carpet yarn producers which use these .heat treating machines would like to supply their customers with both straight-set carpet yarn and textured carpet yarn, with the ratio depending on ever-changing market conditions, there is a demand for machines producing both types of yarn. One solution is to use components of both the Suessen Straight-Set Yarn Machine and the Suessen Textured Yarn Machine and to modify the machines so as to switch between straight-set yarn production and textured yarn production. Both of these systems utilize the same heat-setting chamber and yarn draw-off systems. The Suessen Straight-Set Yarn Machine can be modified to a configuration corresponding to the Suessen Textured Yarn Machine by removing the conveying system for the straight-set yarn and substituting the stuffer box and belt system of the Suessen Textured Yarn Machine. However, the modification to change from straight-set yarn production to textured yarn production requires two to three work days, with consequent labor costs in making the modification. Also lost production during the modification is very costly as these machines are intended to operate continuously, 24 hours a day, seven days a week, to optimize their production efficiency.

An object of the present invention is to overcome the problems in the prior art by providing new methods and apparatus which facilitate the use of a single machine to produce both straight-set yarn and highly crimped yarn by simply adjusting the machine with substantially no loss in production time and no machine modification costs.

Another object of the present invention is to provide new methods and apparatus for converting existing machines, such as the Suessen Textured Yarn Machine so that they can be used to process both straight-set yarn and highly crimped textured yarn, with transition between yarn types requiring virtually no down time.

Another object of the present invention is to provide new methods and apparatus which facilitate production of new types of yarn intermediate the presently known straight-set yarn and highly crimped textured yarn, thereby expanding the range of textured carpet yarn which the carpet yarn suppliers can produce, with consequent expanded options for carpet designers to enhance the variations in carpet textures ultimately produced. In this connection, the relatively straight-set yarn is used for producing commercial straight plush yarns for relatively short pile carpets, while the highly crimped textured yarn is used for producing deeper pile, plusher and shag-type carpets.

Another object of the present invention is to provide new methods and apparatus which permit use of yarn with less initial twist (for example "balanced" twist yarn) to be processed and crimped, as compared to the more highly twisted yarn required by present machines for producing textured carpet yarn. Since this low twist "balanced" yarn is less expensive than more highly twisted yarn, the present invention therefore permits a more economical production of textured carpet yarn.

The above objects are achieved according to preferred embodiments of the invention by providing a new yarn laying system for laying yarn on a conveyor belt which continuously supplies yarn to a heat-setting chamber. This new yarn laying system lays the yarn in predetermined patterns on the moving conveyor belt and is adjustable in a simple manner to vary the yarn pattern laying on the belt and thereby change the degree of crimp achieved in the heat-setting chamber.

In certain preferred embodiments of the invention, a yarn laying system is provided which utilizes a bent yarn supply tube which is driven by an adjustable speed driving motor so that its yarn outlet end oscillates transversely of a longitudinal moving conveyor belt to thereby control the pattern of yarn laying on the conveyor belt.

In certain preferred embodiments of the invention, pressurized air is supplied to the yarn supply tube to aid in transport of the yarn through the yarn supply tube. An adjustable yarn deflecting plate is also provided in certain preferred embodiments of the invention for deflecting the yarn as it falls from the yarn supply tube to the conveyor belt under certain yarn laying pattern conditions.

According to especially advantageous preferred embodiments of the invention, an electronic control system is provided for controlling (i) the speed of yarn feed rollers which control the speed of yarn supplied to the yarn supply tube; (ii) the speed of the driving motor which controls the oscillating speed of the yarn supply tube; and (iii) the speed of the conveyor belt. Also, in preferred embodiments, the vertical distance between the conveyor belt surface and the outlet end of the yarn supply tube is adjustable.

Certain preferred embodiments of the invention include a conversion or replacement kit including a detachable yarn laying system which can be readily substituted for the stuffer box and traverse assembly of the Suessen Textured Yarn Machine. This detachable yarn laying system includes the above-noted yarn supply tube and drive therefor.

Other objects, advantages and novel features of the present invention will become apparent from the following detailed description of the invention when considered in conjunction with the accompanying drawings.

DETAILED DESCRIPTION OF THE DRAWINGS

Figure 1:
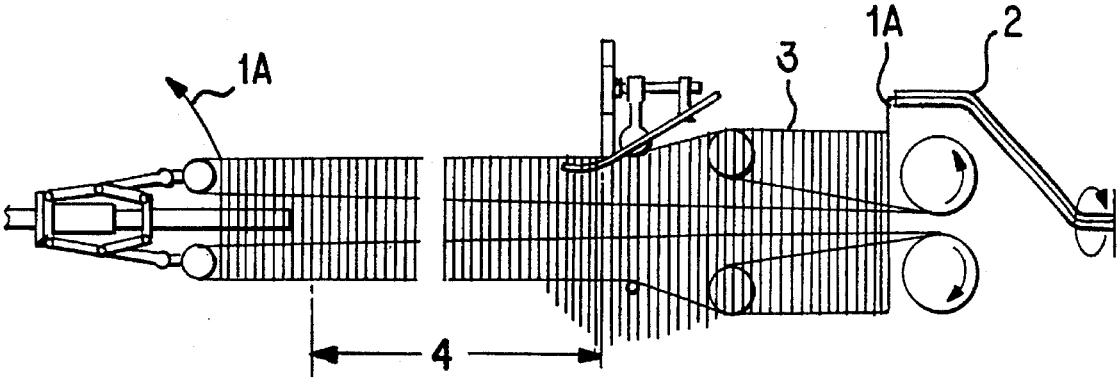
FIG. 1 (PRIOR ART)
FIG. 1 is a schematic side view depicting a prior art arrangement for processing straight-set carpet yarns.

FIG. 1 is a schematic depiction of the Suessen Straight-Set Yarn Machine currently in the market. In FIG. 1, the yarn 1A is continuously supplied as running yarn by way of rotating yarn tube 2 which wraps the yarn 1A around a multiple belt conveying system 3 which moves the yarn in a relaxed state in the direction from a conveyor inlet at the tube 2 and a conveyor outlet end downstream of a heat treatment chamber 4. The yarn 1A is disposed loosely in long loops about one meter in length around the conveyor belt system as it is moved from the right to the left in the FIG. 1 illustration. This system provides for straight-set carpet yarn because the yarn is heat set with virtually no twist applied thereto. Normally, the yarn 1 being heat set includes common synthetic fibers like nylon, polyester and polypropylene, as well as blends. With this system, bulking and heat-setting takes place in a single process in a climate chamber 4 under atmospheric pressure using super-heated steam. This Suessen Straight-Set Yarn Machine is designed for producing straight-set yarn and is not usable to produce textured highly crimped yarn.

Figure 2:
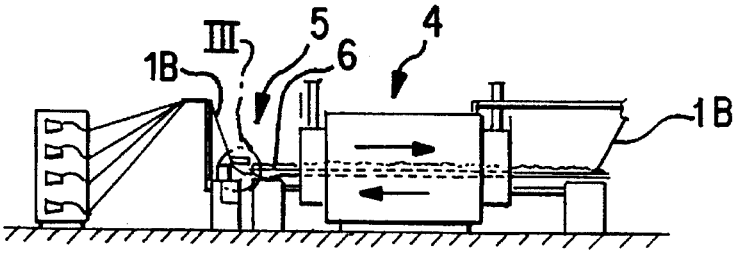
FIG. 2 (PRIOR ART)
FIG. 2 is a schematic side view depicting a prior art system for producing textured carpet yarn.
Figure 3:
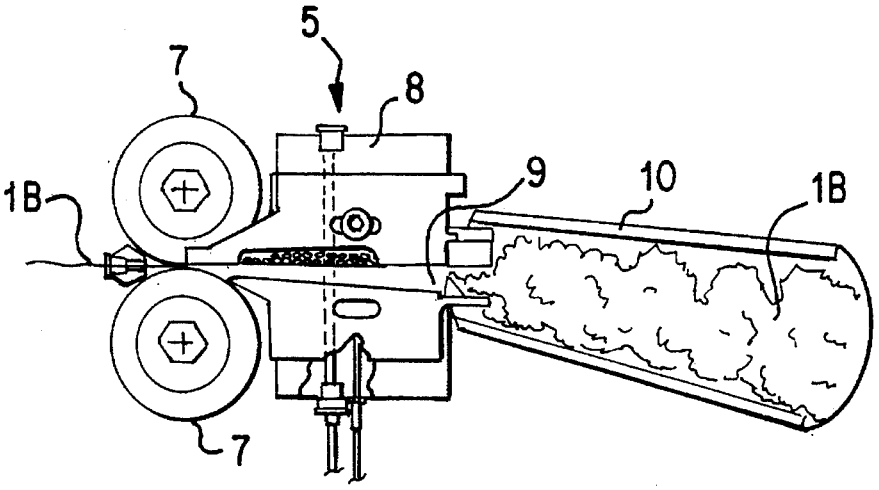
FIG. 3 (PRIOR ART)
FIG. 3 is an enlarged schematic top view taken in the direction of arrow III of FIG. 2, showing details of the stuffer box and traverse box for controlling laying of yarn onto the conveyor belt.

FIGS. 2 and 3 schematically depict the current commercially available Suessen Textured Yarn Machine, which is designed for production of highly crimped or textured carpet yarn. Referring to FIG. 2, yarn ends 1B are supplied via a stuffer box assembly 5 (described more fully with respect to FIG. 3 below). The stuffer box assembly 5 serves to piddle the yarn in a pattern with a multitude of curls (so called "spaghetti" pattern) onto a flat conveyor belt 6 which carries the yarn through the heat-treating chamber 4 where it is heat set. At its outlet end on the right in FIG. 2, the crimped heat-set yarn 1B is then continuously withdrawn.

FIG. 3 is a top view taken in the direction of arrow III of FIG. 2 and shows the yarn 1B which is drawn in by feed rollers 7 and is pushed into a stuffer box assembly 8 which has a spring loaded gate 9 at its outlet end. The outlet end of stuffer box 8 opens onto a traverse member 10 which serves to piddle the yarn in a highly curled spaghetti pattern onto the conveyor belt 6. This prior art Suessen Textured Yarn Machine of FIGS. 2 and 3 is designed for producing highly crimped yarn and is not usable to produce straight-set yarn.

The prior art Suessen Straight-Set Yarn Machine of FIG. 1 can be modified to produce highly crimped textured yarn by replacing the conveying system 3 with the stuffer box assembly 8 and conveyor belt system 6 of the Suessen Textured Yarn Machine of FIGS. 2 and 3. As noted above, this modification of the FIG. 1 machines to include the conveyors and stuffer boxes of the FIG. 2 and FIG. 3 machines requires two to three days of labor and consequent production down time. The costs of conversion between producing straight-set yarn and highly crimped yarn is therefore quite high, especially considering that the machines are designed and intended to run continuously 24 hours a day to optimize yarn production.

Figure 4:
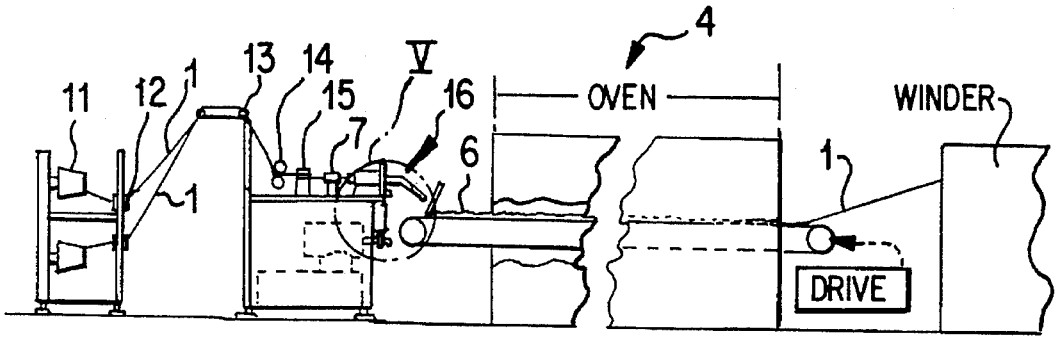
FIG. 4 is a schematic side view depicting a carpet yarn heat-setting system constructed according to a preferred embodiment of the present invention.

A preferred embodiment of the present invention is depicted in FIGS. 4–11. FIG. 4 is a schematic side view depicting yarn ends 1 supplied from a creel 11 by way of guides 12, guiding rollers 13 and 14, and a tension-applying mechanism 15 to the feed rollers 7. The yarn 1 is then supplied from the feed rollers 7 through the novel yarn laying device generally designated 16 onto the conveyor belt 6 which transports the yarn 1 through the heat treatment chamber 4 and then outwardly at the exit end of the heat treatment chamber 4 to a winder 17. As compared to the arrangement of FIGS. 2 and 3, the systems are similar, except for the yarn laying arrangement 16 of the present invention being substituted for the stuffer box assembly 5, 8, 9, 10 of FIG. 3.

In the illustration of FIG. 4, two yarn ends 1 are depicted as being supplied. In practice, it is contemplated that one or more yarn ends can be processed simultaneously through each yarn supply tube and conveyor belt system, with practical embodiments normally processing two to four yarn ends. The following description will describe two single yarn ends being processed, however, it should be understood that a single yarn end and other multiple yarn end processing are also contemplated. Furthermore, the drawings and the following description refer to only a single conveyor belt 6 passing through the heat treating chamber 4. In practical commercial embodiments, such as the above-described Suessen machines already in the market, six conveyor belts are travelling through a single heat treating chamber. Each of the individual belts and yarn supply and guide systems as described herein have separate controls so that they can be independently adjusted and operated. For example, if one of the conveyor belts is inoperative, or the yarn supply is cut off for any of the yarn supply tubes, the remaining conveyors and yarn supply systems continue to operate.

Figure 5:
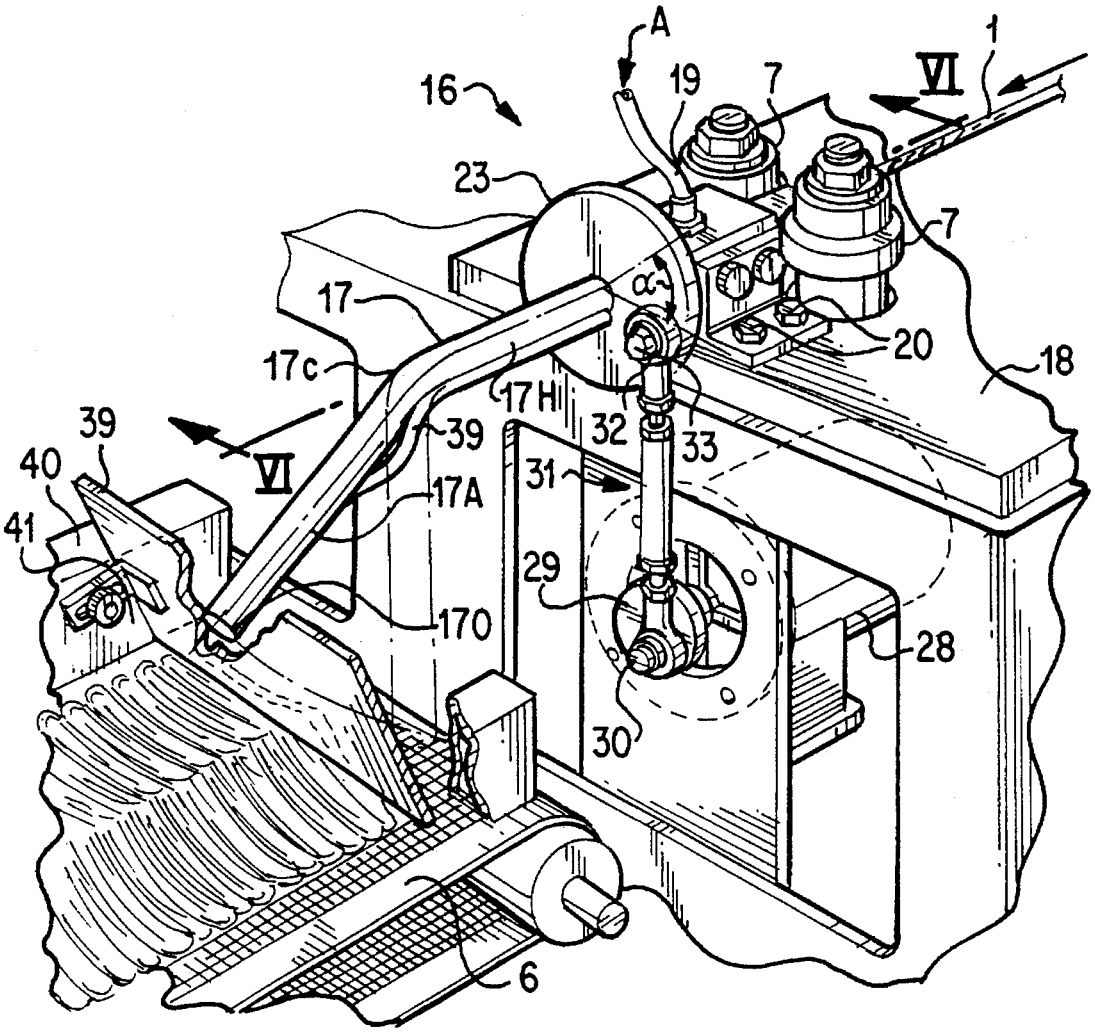
FIG. 5 is a perspective schematic enlarged view, taken in the direction of arrow V of FIG. 4 and depicting details of a preferred embodiment of a yarn laying system for laying yarn in predetermined patterns on the conveyor belt.

Referring to FIG. 5, the novel yarn laying device of the present invention includes a yarn laying tube 17 which extends from its yarn inlet end 17I to its yarn outlet end 17O. A first section 17H is a straight horizontal tube section which is connected to an angularly inclined section 17A by way of curvature section 17C. In practical embodiments, the angle of inclination between the section 17A and 17H is between 35° to 45°. The yarn laying tube 17 is supported at the machine frame 18 by a bearing block assembly 19 which is boltable onto the frame 18 by bolts 20. The bearing block assembly 19 is thus fixedly and detachably attachable to the frame 18.

Inside the block assembly 19, the yarn laying tube section 17H is fixedly supported by way of set screws 21 to a support tube 22 which includes a drive disc 23 integrally formed at one end. Support tube 22 includes a cylindrical section 24 which fits closely against the tube section 17H. The support tube 22 is pivotably/rotatably supported at the bearing block 19 by way of bearings 25.

A cover plate 26 is included at the inlet end 17I of the support tube 22 for supporting same while allowing relative rotational movement of the support tube 22 and the cover plate 26. This part 26 is attached by screws or bolts 27 to the bearing block housing parts 19. The cover plate 26 is tapered at 26T to accommodate positioning of the same intermediate the yarn feed rollers 7, to thereby loosely support the end 17I at the location where the yarn 1 is supplied into the tube 17. The yarn 1, there being two strands or two ends as shown in the illustrated embodiments, extends along the horizontal section 17H inside the tube and then is guided and curved downwardly by way of section 17C to section 17A.

The bearing assembly for the yarn laying tube 17 permits oscillating transverse movement of the outlet end 17O with respect to the belt 6, to thereby control the pattern of laying down of the yarn 1 on the surface of the belt 6. The belt 6 is a permeable flat conveyor belt of known construction as described above with respect to the FIG. 2 prior art arrangement. In use, the oscillating transverse movement of yarn laying tube 17 involves rotational movement over an angle α (see FIG. 5) of about 60°.

To accommodate controlled oscillation of the yarn laying tube 17, a drive motor 28 is supported at the frame 18 and includes a rotating outlet shaft attached to a drive plate 29 which has a drive pin 30 mounted at a location eccentric to the axis of the drive plate 29 such that rotation of the drive plate 29 by the motor 28 causes a reciprocating up and down movement of a connecting rod assembly 31 bearingly and rotatably supported at the pin 30. This connecting rod assembly rod 31 is composed of a turnbuckle assembly which accommodates threaded adjustment of the length of the assembly 31.

At the top of the assembly 31, there is provided a ball joint connection 32 attached to a bolt 33 which is fixed to the driving disc or plate 23 connected to the yarn laying tube 17. The connection point of the bolt 33 to the plate 23 is adjacent the rim of the plate 23, offset from its rotational axis defined by the bearing block assembly 19. Thus, rotary drive movement from motor 28 effects up and down movement of the bolt 33 and consequent transverse oscillating movements of the yarn laying tube outlet end 17O, to thereby control the laying down of the yarn exiting from the tube 17 and placed on the conveyor belt 6. The connection point for the bolt 33 to driving plate 23 is radially adjustable by way of a pin and slot connection, to thereby accommodate changes in the oscillation stroke of the tube 17.

To aid in the supply of the yarn 1 through the yarn laying tube 17, pressurized air A is supplied by way of pressurized air supply tube 34 which opens to the interior of tube 17 at a position downstream of the curved section 17C. Since the tube 17 is curved or bent in order to have a geometry to facilitate the transverse oscillating movement of the outlet end 17O to thereby lay the yarn down in the predetermined pattern on the belt 6, the additional air supply by way of tube 34 is advantageous in overcoming the resistance inside the tube due to this curved configuration. In the FIG. 6 embodiment, the supply of air to tube 34 is by way of an annular channel 35 and a longitudinal connecting channel 36 in the support part 24. The tube 34, as well as the yarn laying tube 17, are formed of stainless steel material and are welded to one another at the weld points 37. The compressed air opening to the tube 17 is at a side of the inside curvature of section 17C, which advantageously prevents catching of the yarn at the opening since the yarn travels at the outside of the curvature.

Figure 13:
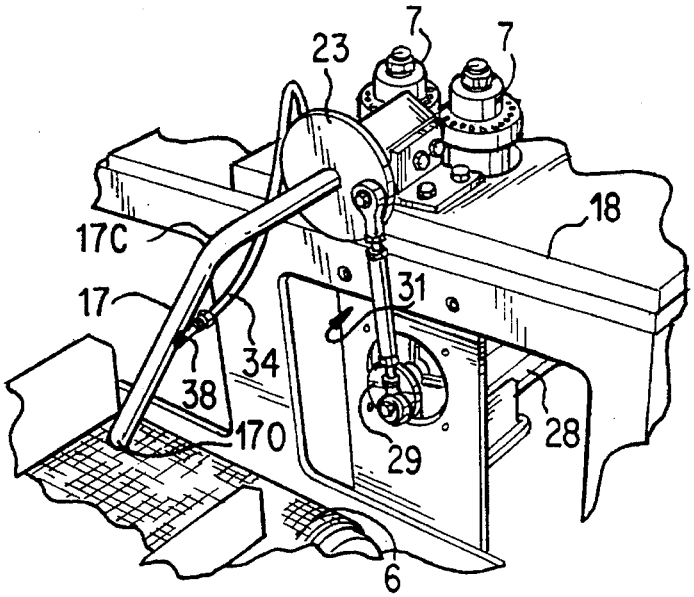
FIG. 13 is a schematic perspective view similar to FIG. 5, showing another embodiment of the yarn supply tube and conveying air supply connection.

In the alternative embodiment of FIG. 13, the air is supplied by way of a plastic tube 34A which fits over a stainless steel nipple 38 welded at the edge of the tube 17 at a position approximately half way intermediate the curved section 17C and the outlet end 17O. An advantage of the embodiment of FIG. 13 is the reduced manufacturing cost and the reduction in total weight that must be oscillated during operation of the system. Other features of the FIG. 13 embodiment are similar to those of the FIG. 6 embodiment and are therefore not further described.

Figure 6:
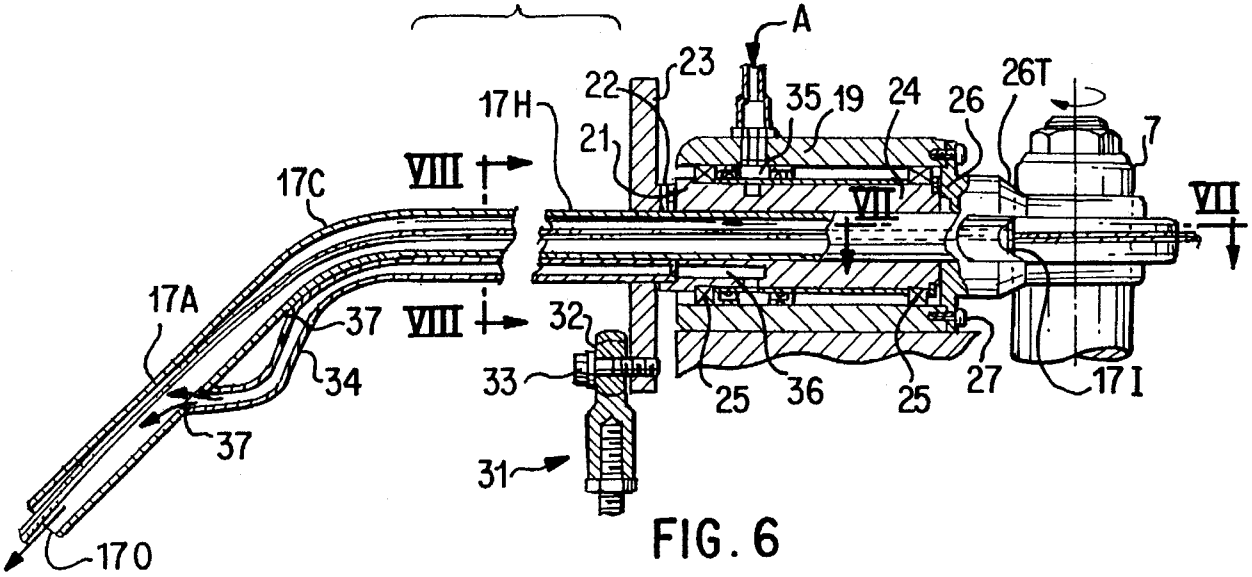
FIG. 6 is a schematic sectional view taken along line VI—VI of FIG. 5.

For both the embodiment of FIGS. 6 and 13, the air is supplied from compressed air sources that are readily available for the machines.

An adjustable yarn deflecting plate 39 is mounted at the frame 40 which supports the conveyor belt 6. This yarn deflecting plate 39 is attached by bolt and slot connection 41 so as to be adjustably inclined in positions to deflect incoming yarn from the tube 17, as well as for movement completely out of the path of any incoming yarn, for reasons explained more fully below.

The heat treating machine described with respect to FIGS. 4–8 is similar to the above-described Suessen Textured Yarn Machine of FIGS. 2 and 3, except that the yarn laying system is different. Thus, the present invention also involves a conversion kit and method for converting the existing Suessen Textured Yarn Machines (or similar machines) as follows. First, the stuffer box assembly 5, including the stuffer box 8, spring loaded gate 9, traverse member 10 and the drive for traverse member 10 are removed from the machine frame 18. Subsequently, the conversion kit including the yarn tube 17, bearing block assembly 19 for supporting the yarn tube 17, the drive motor 28 and drive assembly 29, 30, 31, 23 are installed as respective units. The yarn deflection plate 39 is bolted onto the conveyor support frame 40 by way of bolts 41. The electronic control for the yarn laying oscillating drive motor 28 is connected to the existing control electronics for the Suessen Textured Yarn Machine. Thus, in a relatively simple operation, with a minimum substitution of parts, the Suessen Textured Yarn Machine can be converted to form a machine which is capable of producing a wide range of textured carpet yarns, as well as straight-set carpet yarn.

The operation of the machine system is as follows. The control of the driving motor for the feed rollers, and thus the speed of yarn being processed, as well as the speed of the conveyor belt 6 is done by way of the existing equipment for processing yarns such as on the Suessen Textured Yarn Machine. In these machines, the limiting factors are the capacity of yarn that can be processed in the heat setting chamber, based on the supplied steam characteristics, the dwell time in the heat setting chamber, and the particular types and amounts of yarn to be processed.

To optimize the volume of yarn being treated, it is desired to lay the yarn on the conveyor belt 6 so as to cover the maximum area of the belt 6. Since in the heating chamber, the steam must permeate and heat the yarn on the conveyor belt, use of the entire width of the conveyor belt to hold the yarn as it is conveyed through the heat-setting chamber is desired. For this purpose, the present invention provides that, not only the speed of the driving motor 28 is infinitely variable, the radial attachment point of the drive assembly at 23 to the plate carried by the tube 17 is also adjustable, for example, by way of a slotted connection.

In typical operation of the system of the present invention, the angular extent $\alpha$ of the oscillations is about 60°. The frequency of the oscillations depends upon the type of texture desired in the yarn and the speed of the running yarn being processed.

Figure 8:
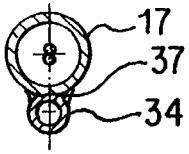
FIG. 8 is a sectional view taken along lines VIII—VIII of FIG. 6.
Figure 7:
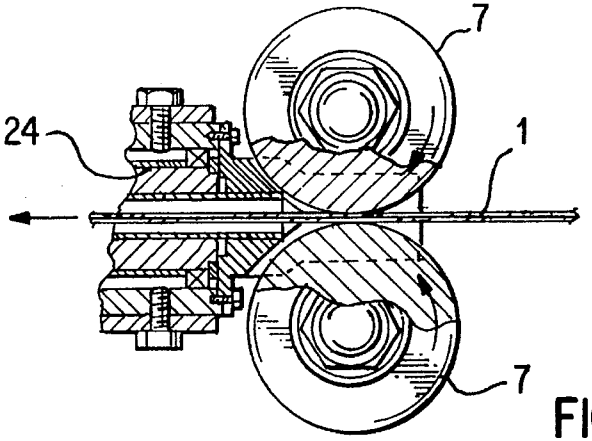
FIG. 7 is a partial sectional view taken along line VII—VII of FIG. 6.
Figure 9:
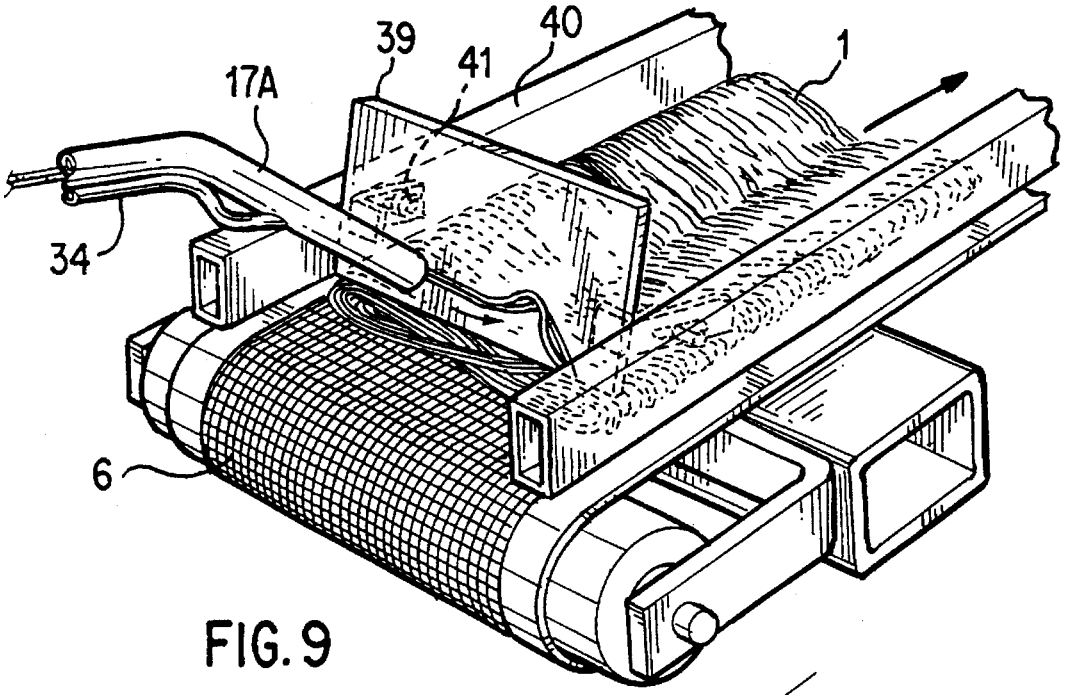
FIG. 9 is a perspective view from above and at an angle showing the oscillating yarn supply tube and conveyor belt combination with the yarn being placed in a controlled figure "8" pattern on the conveyor belt for accommodating straight-set yarn production.
Figure 10A:
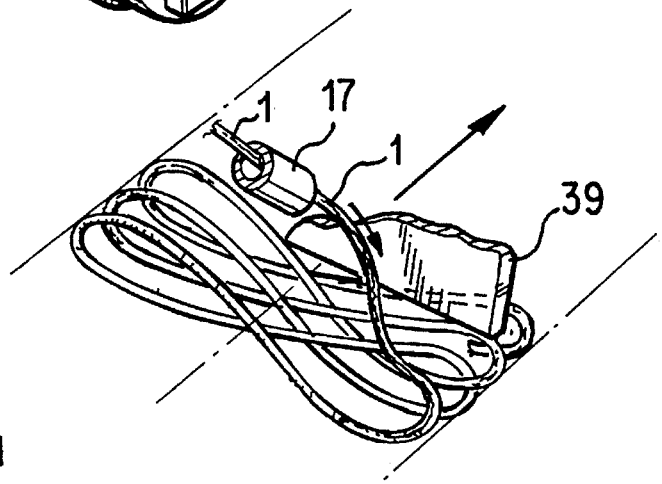
FIGS. 10*a* and 10*b* are partial schematic perspective views depicting details of the laying down of the yarn on the conveyor belt using the system of FIGS. 5 to 8.
Figure 10B:
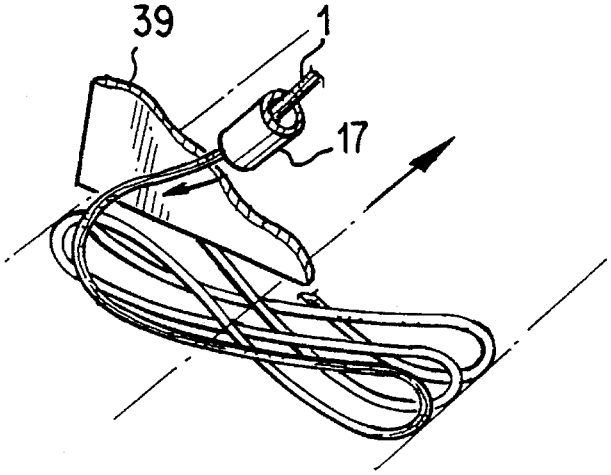

FIGS. 9, 10*a* and 10*b* depict the configuration for producing essentially straight-set yarn. In the commercially available Suessen Textured Yarn Machines, the conveyor width is 250 mm. Presuming that the yarn is to be laid on the conveyor belt with no twist other than the single twist per oscillation required when reversing the yarn at opposite sides of the belt, the oscillation frequency would be 1200 cycles per minute with yarn being supplied at 600 meters per minute. The 600 meter per minute speed of yarn supply is correlated to the production capacity of the heat treating chamber, with throughput of about 350 lbs. per hour (approximately 160 kilograms per hour) of metric yarn count 5 (5 meters of yarn equaling one gram). Accordingly, to provide for the optimum clean figure "8's" as depicted in FIG. 9, covering the entire width of the 250 mm wide conveyor belt 6, the oscillation frequency of the tube 17 would be exactly 1200 cycles per minute or 20 cycles per second. The term figure "8's" for the desired patterns for straight-set yarn is intended to mean a pattern with a single reversal of horizontal direction of the yarn at lateral sides of the belt. These figure "8's" will usually be quite flattened, the degree of flattening depending on the speed of the conveyor belt as compared to the oscillation frequency. It will be understood that having precisely adjustable motor speeds for the motor 28 greatly facilitates setting the precise actual oscillation speed to lay down these clean figure 8 patterns for straight-set yarn production, since there is some minor extra length of yarn in the curvature at the reversal points at opposite sides of the belt. It is contemplated that the precise settings for particular yarn production rates and particular yarn counts and materials will be stored in the electronic computer control system so that they can be replicated for future production runs after a change to another type of yarn count and/or another type of crimping level for the yarn being processed.

FIGS. 9, 10*a* and 10*b* depict the laying down of yarn for straight-set yarn production, which utilizes the yarn deflection plate 39 to assure that the twist point of the yarn being deposited is made in a uniform and orderly manner. The precise functioning of this yarn deflection plate 39 has yet to be determined with certainty, but it appears that the top portion of each "figure 8" exiting from the outlet end 17O of the oscillating feed tube 17 strikes the plate 39, causing the momentum of that portion of the "figure 8" and the accompanying air stream, to be dissipated. As a result, that portion of the yarn falls freely into a relatively calm area of the belt 6, and "figure 8's" of consistent configuration are produced, as depicted in these drawing figures. This consistent configuration of the loops results in a uniform straight-set configuration being set in the heating chamber, and thus, a uniform straight-set configuration for the resulting carpet produced from the yarn.

The shield or deflection plate 39 also prevents the air stream from the tube 17 from upsetting previously deposited loops, which might otherwise upset their consistent configuration of "figure 8's" and also entangle the loops. Deflection plate 39 thus thereby also assures the smooth withdrawal of the yarn from the yarn withdrawal zone of the conveyor belt by the winder at the outlet end of the heat setting chamber. Since the yarn deflection plate 39 is angularly and vertically adjustably mounted at the frame supporting the conveyor belt, the same can be adjusted to the precise best position by the operator during operation of the machine. Appropriate records and indicator markings for the angular and vertical positioning of the yarn deflection plate 39 are to be recorded for the particular yarn type and production speed, so that they can be quickly and easily replicated for later repeat production runs after changes in yarn being produced and/or texture or crimp level being applied.

Figure 11:
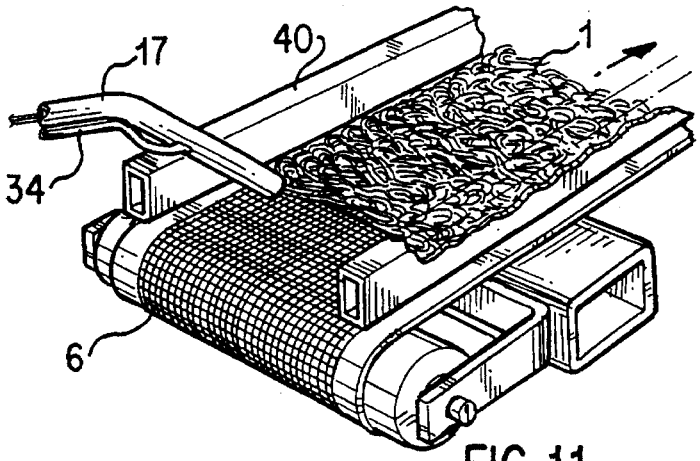
FIG. 11 is a schematic perspective view similar to FIG. 9, however, showing the laying down of yarn in a spaghetti-like pattern for producing highly crimped yarn.

For producing yarn with other than a straight-set configuration, and of varying crimp or texture, the deflection yarn plate 39 is removed or at least moved out of a position engaged by the yarn and/or air stream from the yarn supply tube 17. FIG. 11 schematically depicts the deposition of yarn in a spaghetti-like pattern with multiple tiny loops across the transverse width of the belt. Since the highly crimped yarn requires that the yarn be laid down in other than the simple figure "8" configuration for straight-set yarn, the oscillating speed of the yarn supply tube 17 is substantially reduced as compared to the speed for processing straight-set yarn fed at the same velocity. Since the oscillating speed is infinitely variable in a simple manner, the extent of the loops formed in the laying down of the spaghetti-like pattern on the conveyor belt 6 can be adjusted. Further, repetitive production of similar crimped yarn for future yarn productions is assured by storing the particular yarn tube oscillation speed, vertical height of the yarn tube outlet above the conveyor belt 6, yarn delivery speed, and yarn type. Thus, in a very simple manner, the production runs can be replicated after changes to different types of yarn and/or crimping characteristics being produced.

Figure 12:
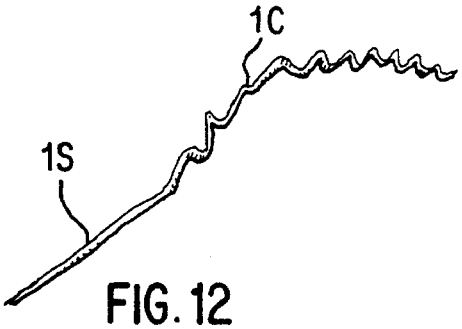
FIG. 12 is a top view of a section of carpet yarn produced in the heat-setting machine of the present invention, and showing the transition between straight-set yarn and highly crimped yarn achieved by merely adjusting the oscillation of the yarn feeding tube in the system of FIG. 5.

FIG. 12 is a drawing depicting a continuous piece of running yarn that was produced on a prototype machine of the present invention. From this FIG. 12, one can see the production of the straight yarn section 1S, followed immediately by the crimped yarn section 1C, the switch in yarn crimp being made while the yarn was running at high production speeds. Thus, it is apparent that the present invention provides for a system and a method of producing crimped yarn which can accommodate changes with virtually no downtime, and virtually no costs for changing from one yarn type to the other.

The present invention also contemplates the method of manufacturing new carpet yarn, including the steps of laying down the yarn on a conveyor belt passing through a heat setting chamber, which laying down of yarn includes feeding the yarn through a bent supply tube which is oscillated at predetermined oscillation speeds to vary the laying down pattern and ultimate crimp heat set into the yarn produced. This method using the system of the present invention, facilitates the production of heretofore unavailable yarn crimp levels intermediate the straight-set yarn and the normal highly crimped yarn.

Different embodiments for deflecting the yarn being laid on the belt than the described plate 39 are also contemplated, such as other deflecting members. For example, cylindrical rods, rectangular bar members, or other deflecting members could be used for certain types of yarn production.

Following are three examples of carpet yarn produced on a prototype of the present invention as described herein.

EXAMPLE I

A two-ply 3.0 cotton count nylon yarn is heat set to produce a relatively straight-set (low crimp) carpet yarn, by concurrently delivering two ends of such yarn to the apparatus. The apparatus is configured to include a shield plate 39 as seen in FIG. 5, and the motor 28 for the feed tube 17 is operated to provide 1200 oscillations per minute, and the motor for the delivery rolls 7 is operated to deliver the yarn at a speed of 600 meters per minute.

EXAMPLE II

Four ends of the yarn of Example I are processed to produce a relatively straight-set carpet yarn on a similarly configured apparatus but with the motor for the feed tube providing 600 oscillations per minute and the motor for the delivery rolls operating to deliver the yarn at a speed of 300 meters per minute.

EXAMPLE III

Two ends of the yarn of Example I are processed to produce a relatively highly crimped or textured yarn on the apparatus configured as in FIG. 11, and with the motor 28 for the feed tube 17 operating to provide 375 oscillations per minute and the motor for the delivery rolls operating to deliver the yarn at a speed of 600 meters per minute.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A replacement kit for replacing a yarn stuffer box assembly on a carpet yarn heat-setting machine of the type having a conveyor belt traveling through a heat setting chamber carrying yarn supplied from driven yarn feed rolls and through a stuffer box assembly disposed between the yarn feed rolls and the conveyor belt, said replacement kit comprising:

a yarn laying device including a yarn outlet end guide and an end guide moving mechanism for reciprocally moving the yarn outlet end guide in directions transverse to the conveyor belt travel direction to thereby control a pattern of yarn on the conveyor belt between a first pattern for processing straight-set yarn to further patterns for processing textured yarn wherein the yarn laying device is a yarn supply tube which is mountable so that a yarn supply tube inlet end is immediately downstream of the yarn feed rolls, an outlet end of the yarn supply tube forming the yarn outlet end guide wherein said yarn supply tube includes a first section which extends along a travel path of yarn fed by the yarn feed rolls and a second section angularly inclined with respect to the first section, and a bearing assembly which is detachably mountable to a machine frame downstream of the yarn feed rolls, said bearing assembly pivotably bearingly supporting the first section of the yarn supply tube.

2. A replacement kit according to claim 1, wherein said end guide moving mechanism includes a variable speed drive assembly for applying reciprocating movement to the yarn supply tube.

3. A replacement kit according to claim 2, comprising a compressed air supply tube opening into said second section of the yarn supply tube for supplying air to aid in conveyance of yarn through the yarn supply tube.

4. A replacement kit according to claim 3, wherein the compressed air supply tube is a plastic tube which is fitted over a nipple integrally fixed on the yarn supply tube.

5. A replacement kit according to claim 3, wherein both the yarn supply tube and the compressed air supply tube are formed of stainless steel.

6. A replacement kit according to claim 2, wherein said variable speed drive assembly includes:

a variable speed electric motor having an output shaft rotatable about an output shaft axis, a first drive plate fixed to the output shaft, a second drive plate fixed to the yarn supply tube, and a connecting rod assembly connecting the first and second drive plates such that rotation of the output shaft is converted to oscillating movement of the yarn supply tube.

7. A yarn laying device for laying running yarn on a moving conveyor of a yarn heat setting machine, said yarn laying device including a yarn outlet end guide and an end guide moving mechanism for reciprocally moving the yarn outlet end guide in directions transverse to the conveyor belt travel direction to thereby control a pattern of yarn on the conveyor belt between a first pattern for processing straight-set yarn to further patterns for processing textured yarn, wherein the yarn laying device is a yarn supply tube which is mountable so that its inlet end is immediately downstream of the yarn feed rolls, an outlet end of the yarn supply tube forming the yarn outlet end guide, and wherein said yarn supply tube includes a first section which extends along a travel path of yarn fed by the yarn feed rolls in a second section angularly inclined with respect to the first section, and a bearing assembly which is detachably mountable to the machine frame downstream of the yarn feed rolls, said bearing assembly pivotably bearingly supporting the first section of the yarn supply tube.

8. A yarn lane device according to claim 7, comprising, wherein said end guide moving mechanism includes a variable speed drive assembly for applying reciprocating movement to the yarn supply tube.

9. A yarn laying device according to claim 8, comprising a compressed air supply tube opening into said second section of the yarn supply tube for supplying air to aid in conveyance of yarn through the yarn supply tube.

10. A yarn laying device according to claim 9, wherein the compressed air supply tube is a plastic tube which is fitted over a nipple integrally fixed on the yarn supply tube.

11. A machine for heat treating running yarn comprising:

a yarn heat setting chamber, a movable yarn conveyor extending through the heat setting chamber, and a yarn laying device for laying running yarn onto the conveyor at a position upstream of the yarn treatment chamber, wherein said yarn laying device includes a yarn outlet end guide mounted for oscillating movement in directions transverse to the yarn conveyor travel direction and an end guide moving mechanism for reciprocally moving the yarn outlet guide in directions transverse to the conveyor belt travel direction to thereby control a yarn pattern carried by the conveyor in the yarn treatment chamber, wherein the movable yarn conveyor is an endless flat belt which in use travels in a longitudinal direction through the heat setting chamber, wherein the yarn laying device is a yarn supply tube having a yarn outlet opening forming the yarn outlet end guide, wherein said end guide moving mechanism is a variable speed tube drive for varying the oscillating speed of the yarn feed tube, and wherein said yarn supply tube includes a first section which extends along a travel path of yarn fed by the yarn feed rolls and a second section angularly included with respect to the first section, and a bearing assembly which is detachably mountable to the machine frame downstream of the yarn feed rolls, said bearing assembly pivotably bearingly supporting the first section of the yarn supply tube.

12. A machine according to claim 11, comprising a variable speed drive assembly for applying reciprocating movement to the yarn supply tube.

13. A yarn supply system for supplying running yarn to a conveyor belt of a yarn heat setting machine, comprising:

a yarn feeder disposed upstream of the conveyor belt along a travel path of running yarn, a transverse yarn oscillator connected downstream of the yarn feeder and upstream of the conveyor belt along the travel path of running yarn, and a speed variater operatively connected to the oscillator for varying the relative speeds of the yarn feeder and the transverse yarn oscillator with respect to one another, wherein a pattern of yarn supplied to the conveyor belt is variable between a first pattern for processing substantially straight-set yarn and further patterns for processing textured yarn.

14. A yarn supply system according to claim 13, wherein the transverse oscillator includes a yarn supply tube having a yarn inlet end and a yarn outlet end, said yarn outlet end forming a transversely movable yarn outlet end guide.

15. A yarn supply system according to claim 14, wherein said yarn supply tube is made of stainless steel.

16. A yarn supply system according to claim 15, wherein said yarn supply tube has an inside diameter between ¼" and ⅝".

17. A yarn supply system according to claim 14 wherein the yarn supply tube includes a first section aligned with the travel path of supplied yarn from the yarn feeder and a second section angularly inclined with respect to the first section, said outlet end being on said second section.

18. A yarn supply system according to claim 17, comprising a compressed air supply tube opening into said second section of the yarn supply tube for supplying air to aid in conveyance of yarn through the yarn supply tube.

19. A yarn supply system according to claim 18, wherein the compressed air supply tube is a plastic tube which is fitted over a nipple integrally fixed on the yarn supply tube.

20. A yarn supply system according to claim 18, wherein both the yarn supply tube and the compressed air supply tube are formed of stainless steel.

21. A yarn supply system according to claim 17 wherein said transverse yarn oscillator includes a variable speed drive assembly for applying oscillating movement to the yarn supply tube.

22. A yarn supply system according to claim 21, further comprising yarn deflection means interposed in a portion of the travel path of yarn between the yarn outlet end guide and the conveyor belt and serving to aid in controlling the pattern of yarn on the conveyor belt.

23. A yarn supply system according to claim 21, wherein said variable speed drive assembly includes:

a variable speed electric motor having an output shaft rotatable about an output shaft axis, a first drive plate fixed to the output shaft, a second drive plate fixed to the yarn supply tube, and a connecting rod assembly connecting the first and second drive plates such that rotation of the output shaft is converted to oscillating movement of the yarn supply tube.

24. A yarn supply system according to claim 13, wherein said yarn feeder includes driven feed rolls engageable with the running yarn.

25. A yarn supply system according to claim 24, further comprising a yarn deflection plate which is adjustably attachable to a conveyor frame member supporting the conveyor belt, said yarn deflection plate being disposed to engage and deflect the yarn traveling from the yarn outlet end guide to the conveyor belt.

26. A yarn supply system according to claim 13, further comprising yarn deflection means interposed in a portion of the travel path of yarn between the yarn outlet end guide and the conveyor belt and serving to aid in controlling the pattern of yarn on the conveyor belt.

27. A yarn supply system according to claim 13, further comprising a yarn deflection plate which is adjustably attachable to a conveyor frame member supporting the conveyor belt, said yarn deflection plate being disposed to engage and deflect the yarn traveling from the yarn outlet end guide to the conveyor belt.

28. A replacement kit for replacing a yarn stuffer box assembly on a carpet yarn heat-setting machine of the type having a conveyor belt traveling through a heat setting chamber carrying yarn supplied from driven yarn feed rolls and through a stuffer box assembly disposed between the yarn feed rolls and the conveyor belt, said replacement kit comprising a yarn laying device including:

a yarn outlet end guide which is reciprocally movable in directions transverse to the conveyor belt travel direction to lay yarn in a pattern on the conveyor belt, and a yarn laying control system for controllably varying the speed of transverse reciprocal movement of the yarn outlet end guide with respect to the yarn supply speed to thereby vary the pattern of yarn on the conveyor belt between a first pattern for manufacturing straight-set yarn and further patterns for manufacturing textured yarn.

29. A replacement kit according to claim 28, wherein the yarn laying device includes a yarn supply tube, an outlet end of the yarn supply tube forming the yarn outlet and guide.

30. A replacement kit according to claim 29, wherein the yarn supply tube includes a first section aligned with a travel path of supplied yarn and a second angularly inclined with respect to the first section, said outlet end being on said second section.

31. A replacement kit according to claim 30 comprising a compressed air supply tube opening into said second section of the yarn supply tube for supplying air to aid in conveyance of yarn through the yarn supply tube.

32. A replacement kit according to claim 31, wherein the compressed air supply tube is a plastic tube which is fitted over a nipple integrally fixed on the yarn supply tube.

33. A replacement kit according to claim 31, wherein both the yarn supply tube and the compressed air supply tube are formed of stainless steel.

34. A replacement kit according to claim 30, wherein said yarn laying control system includes a variable speed drive assembly for applying reciprocating movement to the yarn supply tube.

35. A replacement kit according to claim 34, further comprising yarn deflection means interposed in a portion of the travel path of yarn between the yarn outlet end guide and the conveyor belt and serving to aid in controlling the pattern of yarn on the conveyor belt.

36. A replacement kit according to claim 34, further comprising a yarn deflection plate which is adjustably attachable to a conveyor frame member supporting the conveyor belt, said yarn deflection plate being disposed to engage and deflect the yarn traveling from the yarn outlet end guide to the conveyor belt.

37. A replacement kit according to claim 34, wherein said variable speed drive assembly includes:

a variable speed electric motor having an output shaft rotatable about an output shaft axis, a first drive plate fixed to the output shaft, a second drive plate fixed to the yarn supply tube, and a connecting rod assembly connecting the first and second drive plates such that rotation of the output shaft is converted to oscillating movement of the yarn supply tube.

38. A replacement kit according to claim 29, wherein said yarn supply tube is made of stainless steel.

39. A replacement kit according to claim 29, wherein said yarn supply tube has an inside diameter between ¼" and ⅝".

40. A replacement kit according to claim 28, further comprising yarn deflection means interposed in a portion of the travel path of yarn between the yarn outlet end guide and the conveyor belt and serving to aid in controlling the pattern of yarn on the conveyor belt.

41. A replacement kit according to claim 28, further comprising a yarn deflection plate which is adjustably attachable to a conveyor frame member supporting the conveyor belt, said yarn deflection plate being disposed to engage and deflect the yarn traveling from the yarn outlet end guide to the conveyor belt.

42. A machine for heat treating running yarn comprising:

a yarn heat setting chamber, a movable yarn conveyor extending through the heat setting chamber, and a yarn supply system for supplying running yarn to the conveyor at a position upstream of the yarn treatment chamber, said yarn supply system including:

a yarn feeder disposed upstream of the conveyor belt along a travel path of running yarn, a transverse yarn oscillator connected downstream of the yarn feeder and upstream of the conveyor along the travel path of running yarn, and a speed variater operatively connected to the oscillator for varying the relative speeds of the yarn feeder and the transverse yarn oscillator with respect to one another, wherein a pattern of yarn supplied to the conveyor ms variable between a first pattern for processing substantially straight-set yarn and further patterns for processing textured yarn.

43. A machine according to claim 42, wherein the movable yarn conveyor includes an endless flat belt which in use travels in a longitudinal direction through the heat setting chamber, and wherein the transverse yarn oscillator includes a yarn supply tube having a yarn inlet end and a yarn outlet end, said yarn outlet end forming a transversely movable yarn outlet end guide.

44. A machine according to claim 43, comprising a variable speed belt drive for varying the travelling speed of the endless belt.

45. A machine according to claim 44, wherein the yarn feeder includes variable adjustable speed yarn feed rolls disposed immediately upstream of the yarn supply tube.

46. A machine according to claim 45, wherein said transverse yarn oscillator includes a variable speed feed tube drive for varying the oscillating speed of the yarn feed tube.

47. A machine according to claim 46, wherein said yarn supply tube includes a first section which extends along a travel path of yarn fed by the yarn feed rolls and a second section angularly inclined with respect to the first section.

48. A machine according to claim 47, comprising a bearing assembly which is detachably mountable to the machine frame downstream of the yarn feed rolls, said bearing assembly pivotably bearingly supporting the first section of the yarn supply tube.

49. A machine according to claim 48, comprising a compressed air supply tube opening into said second section of the yarn supply tube for supplying air to aid in conveyance of yarn through the yarn supply tube.

50. A machine according to claim 47, wherein said variable speed drive assembly includes:

a variable speed electric motor having an output shaft rotatable about an output shaft axis, a first drive plate fixed to the output shaft, a second drive plate fixed to the yarn supply tube, and a connecting rod assembly connecting the first and second drive plates such that rotation of the output shaft is converted to oscillating movement of the yarn supply tube.

51. A method of laying running yarn on a longitudinally moving conveyor belt of a yarn heat setting machine, comprising:

feeding yarn to a yarn laying device at a yarn supply speed, and laying the yarn with the yarn laying device in a transversely oscillating manner on the longitudinally moving conveyor belt so that the yarn is disposed in a pattern on the conveyor belt, wherein said laying the yarn includes varying the speed of translation oscillation of the yarn with respect to the yarn supply speed to thereby vary the pattern of yarn on the conveyor belt between a first pattern for manufacturing straight-set yarn and further patterns for manufacturing textured yarn.

52. A method according to claim 51, comprising:

moving the conveyor belt through a yarn treatment chamber with the yarn in said predetermined pattern on the conveyor belt, supplying heated steam to the running yarn as it is conveyed through the yarn treatment chamber, and withdrawing treated yarn from the yarn treatment chamber.

53. A method according to claim 52, wherein said feeding running yarn includes supplying the running yarn from feed rollers through a yarn supply tube which has a first section which in use extends along a travel path of yarn fed by the yarn feed rollers and a second section angularly inclined with respect to the first section.

54. A method according to claim 53, wherein said feeding includes controlling oscillating movement of the outlet end of the yarn supply tube by way of a variable speed motor.

55. A method according to claim 51, comprising deflecting the yarn by yarn deflecting means interposed in a portion of the travel path between the yarn outlet end guide in the conveyor belt and serving to aid in controlling the pattern of yarn on the conveyor belt.

56. A method according to claim 51, further comprising deflecting the yarn by means of an adjustably movable plate interposed in a portion of the travel path of yarn between the yarn outlet end guide and the conveyor belt and serving to aid in controlling the pattern of yarn on the conveyor belt.

57. A machine for heat treating running yarn comprising:

a yarn heat setting chamber, a movable yarn conveyor extending through the heat setting chamber, and a yarn laying device for laying running yarn onto the conveyor at a position upstream of the yarn treatment chamber, wherein said yarn laying device includes a yarn outlet end guide mounted for oscillating movement in directions transverse to the yarn conveyor travel direction and an end guide moving mechanism for reciprocally moving the yarn outlet guide in directions transverse to the conveyor belt travel direction to thereby control a yarn pattern carried by the conveyor in the yarn treatment chamber, wherein the movable yarn conveyor is an endless flat belt which in use travels in a longitudinal direction through the heat setting chamber, wherein the yarn laying device is a yarn supply tube having a yarn outlet opening forming the yarn outlet end guide, wherein said end guide moving mechanism is a variable speed tube drive for varying the oscillating speed of the yarn feed tube, and wherein said yarn supply tube includes a first section which extends along a travel path of yarn fed by the yarn feed rolls and a second section angularly included with respect to the first section, wherein said variable speed drive assembly includes:

a variable speed electric motor having an output shaft rotatable about an output shaft axis, a first drive plate fixed to the output shaft, a second drive plate fixed to the yarn supply tube, and a connecting rod assembly connecting the first and second drive plates such that rotation of the output shaft is converted to oscillating movement of the yarn supply tube.

* * * * *